US007366434B2

(12) United States Patent
Ream et al.

(10) Patent No.: US 7,366,434 B2
(45) Date of Patent: Apr. 29, 2008

(54) PERIODIC DOCTOR ELEMENT FIELD REVERSAL IN AN ELECTROPHOTOGRAPHIC DEVICE

(75) Inventors: Gregory L. Ream, Lexington, KY (US); Michelle K. Morris, Lexington, KY (US); William A. Menk, Jr., Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 248 days.

(21) Appl. No.: 11/220,945

(22) Filed: Sep. 7, 2005

(65) Prior Publication Data

US 2007/0053707 A1 Mar. 8, 2007

(51) Int. Cl.
*G03G 15/06* (2006.01)
*G03G 21/00* (2006.01)
*G03G 15/08* (2006.01)

(52) U.S. Cl. ..... 399/55; 399/99; 399/284

(58) Field of Classification Search ..... 399/55, 399/99, 149, 283, 284, 285, 286
See application file for complete search history.

(56) References Cited

U.S. PATENT DOCUMENTS 4,509,225 A 4/1985 Haugen
5,519,472 A 5/1996 Ojima et al.
5,570,166 A 10/1996 Ohzeki et al.
5,682,585 A 10/1997 Yamaguchi et al.
5,970,297 A 10/1999 Gross
5,999,773 A 12/1999 Yasutomi et al.
6,415,127 B1 7/2002 Yamamoto et al.
6,463,245 B1 10/2002 Suwa et al.
6,751,423 B2 * 6/2004 Sakaizawa et al. ..... 399/55
6,829,446 B2 12/2004 Toizumi et al.

* cited by examiner

*Primary Examiner*—Hoang Ngo
(74) *Attorney, Agent, or Firm*—Coats & Bennett, PLLC

(57) ABSTRACT

A method and apparatus to clear the accumulation of toner particles from a doctor element by periodically reversing a bias field between a doctor element and a developer member. The developer member may be biased to a first electrical potential while the doctor element may be biased to a second electrical potential. The second electrical potential may be higher than the first electrical potential. The doctor element and the developer member may be biased from a single voltage supply and a voltage dividing circuit. A bias reversing circuit may cause the second electrical potential to fall, at least temporarily, below that of the first electrical potential when power from the voltage supply is removed. The bias reversing circuit may also cause the first electrical potential to fall with a longer time constant than that of the second electrical potential when power from the voltage supply is removed.

24 Claims, 5 Drawing Sheets

PERIODIC DOCTOR ELEMENT FIELD REVERSAL IN AN ELECTROPHOTOGRAPHIC DEVICE

BACKGROUND

Certain image forming devices use an electrophotographic imaging process to develop toner images on a media sheet. The electrophotographic process uses a number of electrostatic voltage differentials to promote the transfer of toner from component to component. For example, a voltage vector may exist between a developer member and a latent image on a photoconductive element. This voltage vector helps promote the transfer of toner from the developer member to the latent image in a process that is sometimes called "developing the image." A separate voltage vector may exist between the photoconductive element and a transfer member to promote the transfer of a developed image onto a substrate. In each instance, the toner transfer occurs in part because the toner itself is charged and is attracted to surfaces having an opposite charge or a lower potential.

Many toners comprise a single-component formulation. The term "single-component" is usually understood to mean that the toner does not have magnetic particle additives that are used in some two-component toner formulations to promote toner transfer. Despite the name, some single-component toner formulations include extra-particulate additives (EPA's) that improve fluidity and other printing properties. EPA's are bound to the surface of toner particles by mechanical, VanderWaals, and electrostatic forces. When toner containing these EPA's are conveyed past a biased component, the EPA's may separate from the toner under the influence of local electrostatic fields.

In certain instances, these separated EPA's can begin to accumulate over time to form a barrier that restricts toner flow resulting in undeveloped streaks in the final image. One area where this problem is particularly noticeable is in the region between a doctor element and a developer member. A doctor element in an electrophotographic device controls the thickness (and in some cases, the charge) of the layer of toner on a developing roller that ultimately develops a latent image. This region is problematic because the gap between the doctor element and the developing roller is small (i.e., on the order of a few toner particles). Thus, while EPA's may be small in comparison to the size of toner particles, the accumulation thereof may quickly result in degraded image quality.

SUMMARY

Embodiments of a field reversal circuit and methods of operation are directed to clearing the accumulation toner particles from a doctor element. This accumulation may be induced when toner additives having a charge opposite to the toner particles are attracted to a doctor element having a larger potential than a developer roller. By periodically reversing a bias field between the doctor element and a developer member, these particles may be cleared. The doctor element and the developer member may be biased from a single voltage supply and a voltage dividing circuit. A bias reversing circuit may cause the doctor element bias to fall, at least temporarily, below that of the developer member when power from the voltage supply is removed. The bias reversing circuit may also cause the developer member bias to fall with a longer time constant than that of the doctor element when power from the voltage supply is removed.

In practice, the field reversal circuit operates by initially biasing a doctor element and a developer member to different potentials. This voltage differential may be created with a single power supply and a voltage dividing circuit. Upon removing power from the power supply, the field reversal circuit may cause the doctor blade bias level to fall towards electrical ground with a first time constant. The field reversal circuit may also cause the developer member bias level to fall towards electrical ground with a second time constant that is longer than the first time constant. The amount and duration of the field reversal may be controlled using a voltage regulator, such as a Zener diode, and an energy storage element such as a capacitor.

DETAILED DESCRIPTION

Figure 1:
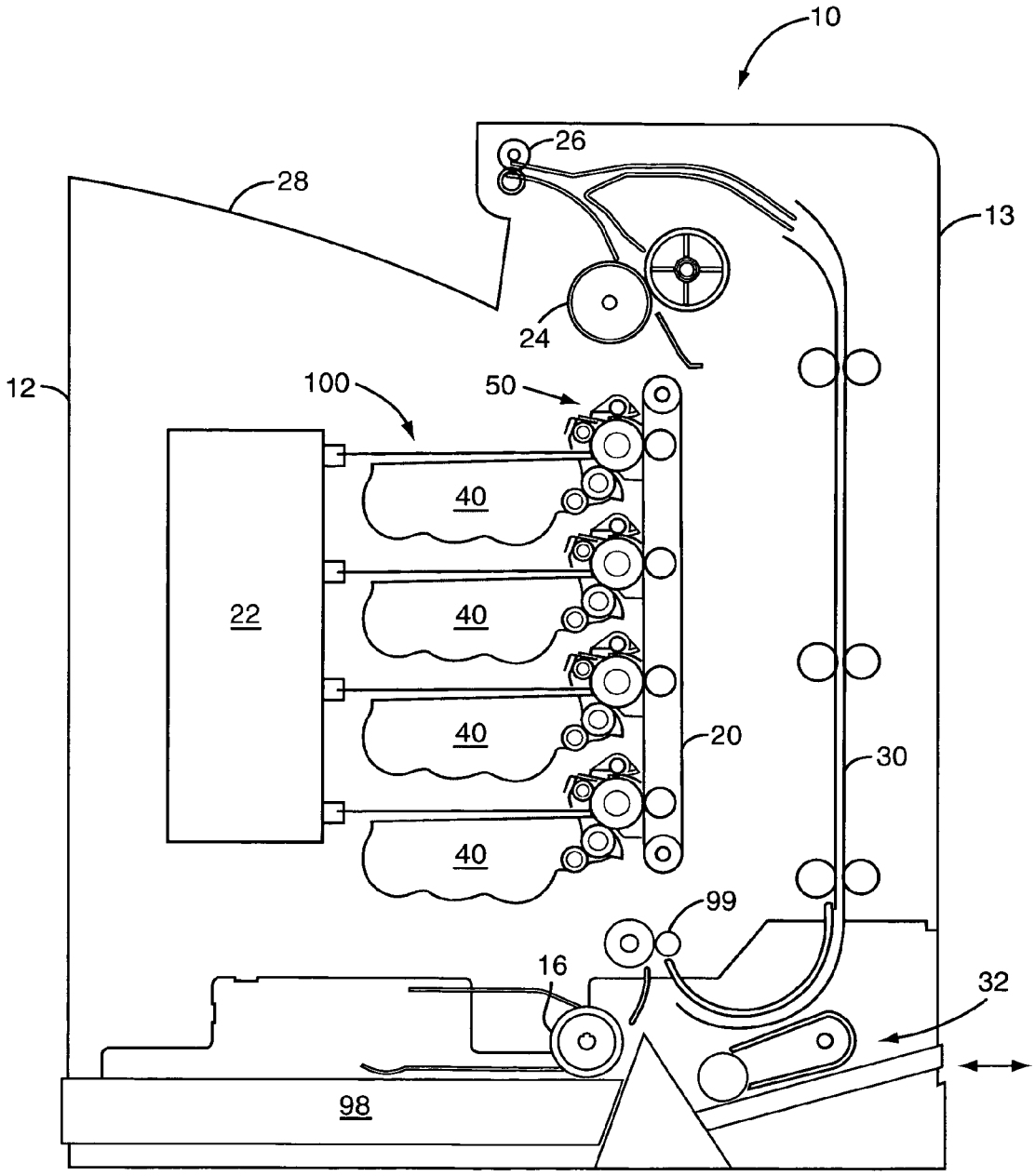
FIG. 1 is a schematic view of an image forming device according to one embodiment of the present invention.

Embodiments disclosed herein are directed to an apparatus and related method for improving developed image quality through periodic clearing of toner particles. These embodiments may be applicable in a device that uses an electrophotographic imaging process such as the representative image forming device 10 shown in FIG. 1. The exemplary image forming device 10 comprises a main body 12 and a door assembly 13. A media tray 98 with a pick mechanism 16, or a multi-purpose feeder 32, are conduits for introducing media sheets into the device 10. The media tray 98 is preferably removable for refilling, and located on a lower section of the device 10.

Media sheets are moved from the input and fed into a primary media path. One or more registration rollers 99 disposed along the media path aligns the print media and precisely controls its further movement along the media path. A media transport belt 20 forms a section of the media path for moving the media sheets past a plurality of image forming units 100. Color printers typically include four image forming units 100 for printing with cyan, magenta, yellow, and black toner to produce a four-color image on the media sheet.

An optical scanning device 22 forms a latent image on a photoconductive member 51 (not explicitly shown in FIG. 1, but see FIG. 2) within the image forming units 100. The media sheet with loose toner is then moved through a fuser 24 that adheres the toner to the media sheet. Exit rollers 26 rotate in a forward direction to move the media sheet to an output tray 28, or rollers 26 rotate in a reverse direction to move the media sheet to a duplex path 30. The duplex path 30 directs the inverted media sheet back through the image formation process for forming an image on a second side of the media sheet.

Figure 2:
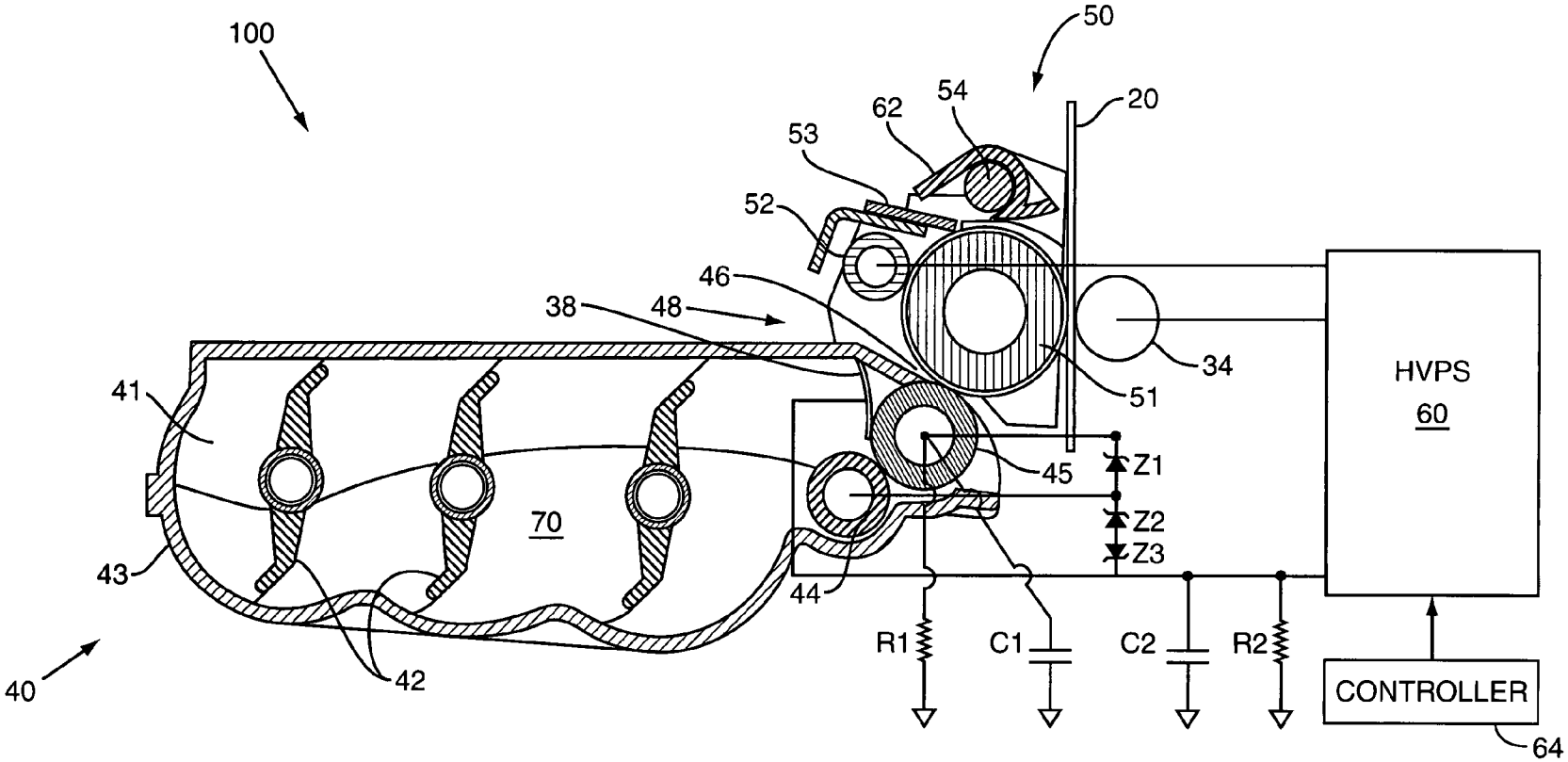
FIG. 2 is a cross-sectional view of an image forming unit and associated power supply and field reversing circuitry according to one embodiment of the present invention.

As illustrated in FIGS. 1 and 2, the image forming units 100 are comprised of a developer unit 40 and a photoconductor (PC) unit 50. The developer unit 40 comprises an exterior housing 43 that forms a reservoir 41 for holding a supply of toner 70. One or more agitating members 42 are positioned within the reservoir 41 for agitating and moving the toner 70 towards a toner adding roll 44 and the developer member 45. The developer unit 40 further comprises a doctor element 38 that controls the toner 70 layer formed on the developer member 45. In one embodiment, a cantilevered, flexible doctor blade as shown in FIG. 2 may be used. Other types of doctor elements 38, such as spring-loaded, ingot style doctor elements may be used. The developer unit 40 and PC unit 50 are structured so the developer member 45 is accessible for contact with the photoconductive member 51 at a nip 46. Consequently, the developer member 45 is positioned to develop latent images formed on the photoconductive member 51.

The exemplary PC unit 50 comprises the photoconductive member 51, a charge roller 52, a cleaner blade 53, and a waste toner auger 54 all disposed within a housing 62 that is separate from the developer unit housing 43. In one embodiment, the photoconductive member 51 is an aluminum hollow-core drum coated with one or more layers of light-sensitive organic photoconductive materials. The photoconductive member 51 is mounted protruding from the PC unit 50 to contact the developer member 45 at nip 46. Charge roller 52 is electrified to a predetermined bias by a high voltage power supply (HVPS) 60 that is adjusted or turned on and off by a controller 64. The charge roller 52 applies an electrical charge to the surface of the photoconductive member 51. During image creation, selected portions of the surface of the photoconductive member 51 are exposed to optical energy, such as laser light, through aperture 48. Exposing areas of the photoconductive surface 51 in this manner creates a discharged latent image on the photoconductive member 51. That is, the latent image is discharged to a lower charge level than areas of the photoconductive member 51 that are not illuminated.

The developer member 45 (and hence, the toner 70 thereon) is charged to a bias level by the HVPS 60 that is advantageously set between the bias level of charge roller 52 and the discharged latent image. One embodiment for charging the developer member 45 to this intermediate bias level is described in further detail below. In one embodiment, the developer member 45 is comprised of a foam roller disposed around a conductive axial shaft. Other compliant and rigid roller-type developer members 45 as are known in the art may be used. Charged toner 70 is carried by the developer member 45 to the latent image formed on the surface of the photoconductive member 51. As a result of the imposed bias differences, the toner 70 is attracted to the latent image and repelled from the remaining, higher charged portions of the photoconductive surface. At this point in the image creation process, the latent image is said to be developed.

The developed image is subsequently transferred to a media sheet being carried past the photoconductive member 51 by media transport belt 20. In the exemplary embodiment, a transfer roller 34 is disposed behind the transport belt 20 in a position to impart a contact pressure at the transfer nip. In addition, the transfer roller 34 is advantageously charged, typically to a polarity that is opposite the charged toner 70 and charged photoconductive member 51 to promote the transfer of the developed image to the media sheet.

The cleaner blade 53 contacts the surface of the photoconductive member 51 to remove toner 70 that remains on the photoconductive member 51 following transfer of the developed image to a media sheet passing between the photoconductive member 51 and the media transport belt 20. The residual toner 70 is moved to a waste toner auger 54. The auger 54 moves the waste toner 70 out of the photoconductor unit 50 and towards a waste toner container (not shown), which may be disposed of once full.

In one embodiment, the charge roller 52, the photoconductive member 51, the developer member 45, the doctor element 38 and the toner adding roll 44 are all negatively biased. The transfer roller 34 may be positively biased to promote transfer of negatively charged toner 70 particles to a media sheet. Those skilled in the art will comprehend that an image forming unit 100 may implement polarities opposite from these.

In one embodiment, the toner adding roll 44, the developer member 45, and the doctor element 38 are biased to different voltage levels. The toner adding roll 44 may be biased to a voltage level that is between that of the developer member 45 and the doctor element 38. The doctor element 38 may be charged to a higher potential than the toner adding roll 44 and the developer member 45. Each of these components may be charged independently. However, in the embodiment shown, the toner adding roll 44, the developer member 45, and the doctor element 38 are charged from a common voltage supply line 66. To achieve these different voltage levels, a voltage dividing circuit comprising a biased string of Zener diodes Z1 and Z2 is used.

The ratings of Zener diodes Z1, Z2 determine the difference in voltage supplied to the doctor element 38, toner adding roll 44, and the developer member 45. In one embodiment, Zener diode Z1 is rated at 180 volts while Zener diode Z2 is rated at 60 volts. Assuming a voltage higher than the cumulative ratings of these Zener diodes Z1, Z2 is available on supply line 66, the toner adding roll 44 will be biased to a voltage that is 60 volts lower than that of the doctor element 38. Similarly, the developer member 45 will be biased to a voltage level that is 180 volts lower than that of the toner adding roll 44 and 240 volts lower than that of the doctor element 38. For an embodiment that uses negatively biased components, it may be more accurate to state that the doctor element 38 is biased to a voltage level that is 240 volts more negative than the developer member 45. In an exemplary embodiment, a voltage of about −840 volts may be supplied to the doctor element 38 via supply line 66. Accordingly, the toner adding roll 44 will be biased to a voltage of about −780 volts and the developer member 45 will be biased to a voltage of about −600 volts. These voltage levels are merely representative as their values may change depending on operating conditions.

A bias resistor R1 from the developer member 45 return provides a current flow through the Zener diodes Z1, Z2 to turn them on when a sufficiently high voltage (i.e., higher than the cumulative rating of Zener diodes Z1, Z2) is present on supply line 66. A filter capacitor C2 filters the output on supply line 66 to reduce ripple induced by rectification within the HVPS 60. In one embodiment, a capacitor C2 rated between about 100 pF to about 470 pF may be used.

During image formation, toner 70 moves from the toner reservoir 41, past the agitators 42, which begin to induce friction charging of the toner 70, and towards the charged toner adding roll 44. Toner 70 that is picked up and moved by the toner adding roll 44 may be charged to a similar potential as the toner adding roll 44. Consequently, this charged toner 70 is attracted to the developer member 45, which has a lower potential than the toner adding roll 44. Further, the charged toner 70 that is deposited onto the developer member 45 is generally repelled by the doctor element 38.

Figure 3:
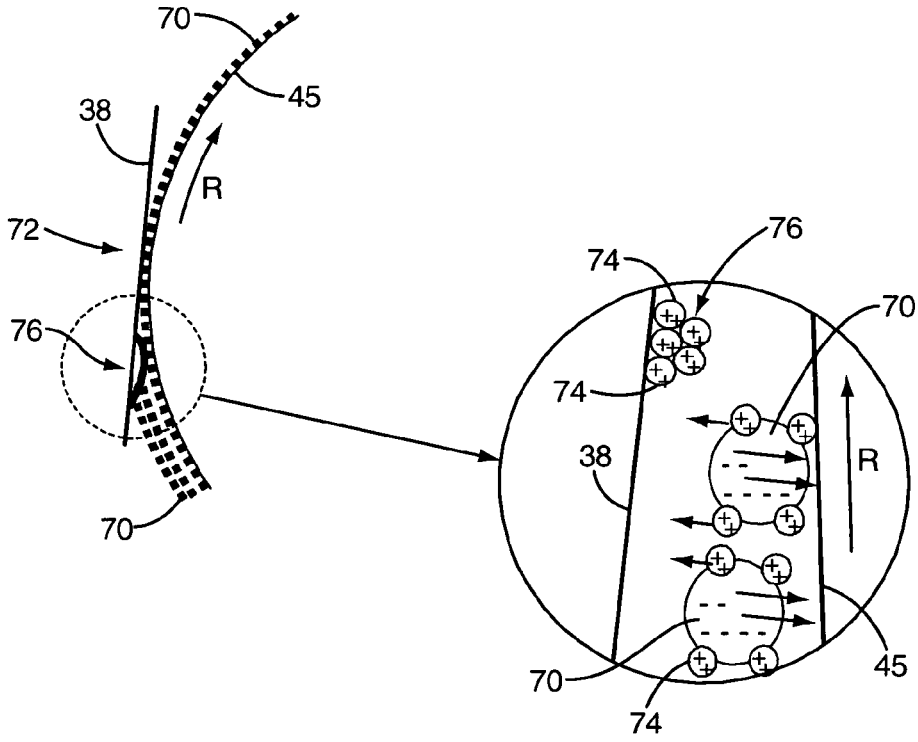
FIG. 3 is a schematic diagram showing local toner particle effects from a toner doctor field during printing according to one embodiment of the present invention.

FIG. 3 illustrates the interaction between particles of toner 70 and the doctor element 38 and developer member 45 in the vicinity of a doctoring nip 72 between these components. The electric field between the doctor element 38 and the developer member 45 acts on the toner 70 entering the doctoring nip 72 between the doctor element 38 and the developer member 45. Furthermore, toner 70 experiences mechanical agitation in the vicinity of the doctoring nip 72 where a majority of toner is blocked from passing through the doctoring nip 72.

FIG. 3 further illustrates a plurality of extra-particulate additive (EPA) particles 74 that are included in one formulation of the toner 70. The EPA particles 74 are added to toner to modify the overall properties of the toner 70. For instance, the EPA particles 74 may improve fluidity or other printing properties. The EPA particles 74 are bound to the surface of toner particles 70 by mechanical, VanderWaals, and electrostatic forces. In the present embodiment, these EPA particles 74 generally have a positive charge as indicated by the + symbols. The toner particles 70, as indicated above, are negatively charged (as indicated by the – symbols). In the embodiment shown in FIG. 3, the combination of toner 70 and EPA 74 has a net negative charge. Consequently, the composite toner 70 plus EPA 74 particles are repelled by the doctor element 38, which is at a higher potential, and attracted by the developer member 45, which is at a lower potential. However, in the vicinity of the doctoring nip 72, the combination of mechanical agitation and the electric field between the doctor element 38 and developer member 45 acts to dislodge weakly held EPA particles 74 from toner particles 70. These dislodged EPA particles 74 tend to accumulate in the area immediately upstream (relative to the developer member 45 direction of rotation R) of the doctoring nip 72. An accumulation 76 of EPA particles 74 may eventually build to the point that toner 70 entry to the doctoring nip 72 is restricted.

Figure 4:
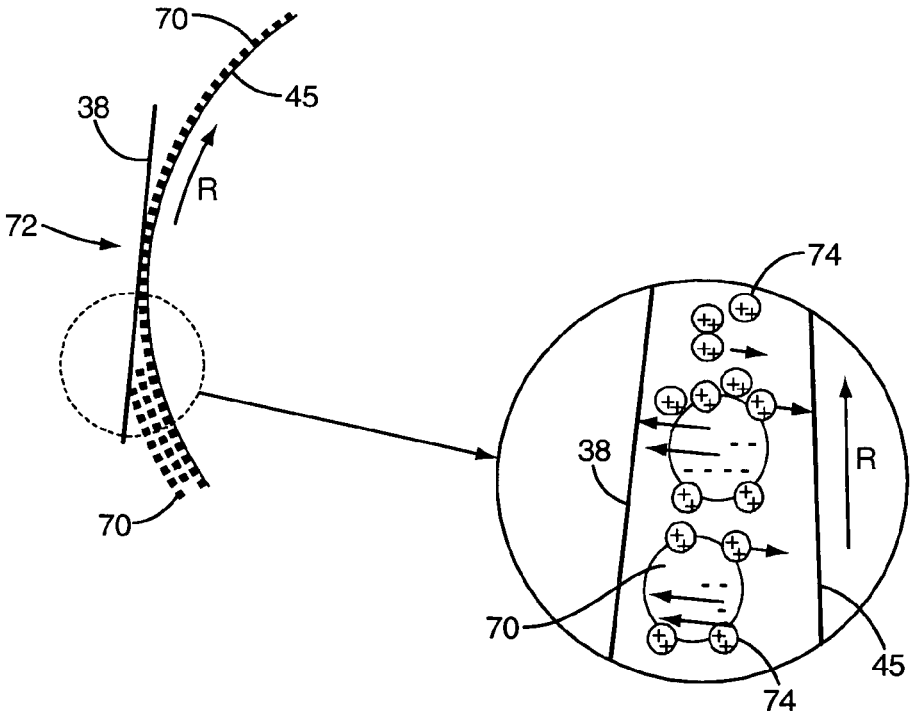
FIG. 4 is a schematic diagram showing local toner particle effects from a reversed toner doctor field according to one embodiment of the present invention.

Accordingly, the HVPS 60 biasing circuit shown in FIG. 2 further comprises reversing circuitry that periodically reverses the electric field between the doctor element 38 and the developer member 45. During normal printing, the doctor element 38 is biased to a larger potential than the developer member 45. The EPA particles 74 may be cleared during a period of time that the doctor element 38 is biased to a smaller potential than the developer member 45. For embodiments where negative voltages are applied to the doctor element 38 and the developer member 45, a more positive voltage is applied to the doctor element 38 during this clearing period to repel the EPA particles 74 from the doctor element 38. This reverse bias is illustrated schematically in FIG. 4, where the accumulation 76 of EPA particles 74 is cleared away from the doctor element 38. This reverse bias may also attract negatively charged toner particles 70 towards the doctor element 38 where the motion of the toner 70 can loosen and/or carry away EPA particles 74.

The amount and duration of the field reversal should be adequate to clear the accumulation 76 of EPA particles 74. An image charge force proportional to $q^2/r^2$ exists between the doctor element 38 and charged particles. Thus, the electrostatic attraction to the doctor element 38 will be greatest for particles characterized by a large charge and smaller radii. Accordingly, the various embodiments disclosed herein may be generally applicable to fine toner particles (i.e., not limited to EPAs) having a charge that is substantially different than the composite toner charge and a size that is toward the low end of the particle size distribution. For example, the toner particles that are attracted to the doctor element 38 may have a high charge, a low charge, or a charge that is opposite in polarity from the composite toner charge. Further, the various embodiments disclosed herein may be appropriate to remove particles (EPAs or otherwise) that have a size of less than about 10 to 20 percent of the mean particle diameter. It has been determined that an external electric field reversal of about 200 volts sustained for a duration of about 50 ms and producing a Lorenz force qE is sufficient to clear particles having a diameter of a few microns from a doctor element 38. This field reversal is applicable to one embodiment using a cantilevered doctor blade with an overhang length of between about 1 mm, a toner charge of about 35 μC/gram, and a developer roll diameter of about 15.1 mm. The amount and duration of the field reversal may be changed for different configurations.

In the embodiment of the HVPS 60 biasing circuit shown in FIG. 2, the field reversal may be implemented by the Zener diode Z3 and capacitor C1. In one embodiment, Zener diode Z3 is rated at about 240 volts and the capacitor C1 is rated about 0.01 μF. Note that the Zener diode Z3 is oriented with a polarity that is opposite to Zener diodes Z1 and Z2. For the period of time that the developer member 45 potential exceeds the potential of the doctor element 38 by more than the Zener diode Z3 rating, the Zener diode Z3 turns on. Further, the relatively large capacitor C1 operates as an energy storage device that resists voltage changes. Thus, when the voltage from the HVPS 60 (on supply line 66) is removed, the voltage at the developer member 45 falls much more slowly than the voltage at the doctor element 38. A bleeder resistor R2 pulls the doctor element 38 toward ground with a short time constant while the developer member 45 decays more slowly. With this configuration, the field reversal may be induced after each print job, during the inter-image period at the developer roll nip that corresponds to an inter-page gap at the transfer nip. During this period, the rotating components, including the developer member 45 continue to rotate.

Figure 5:
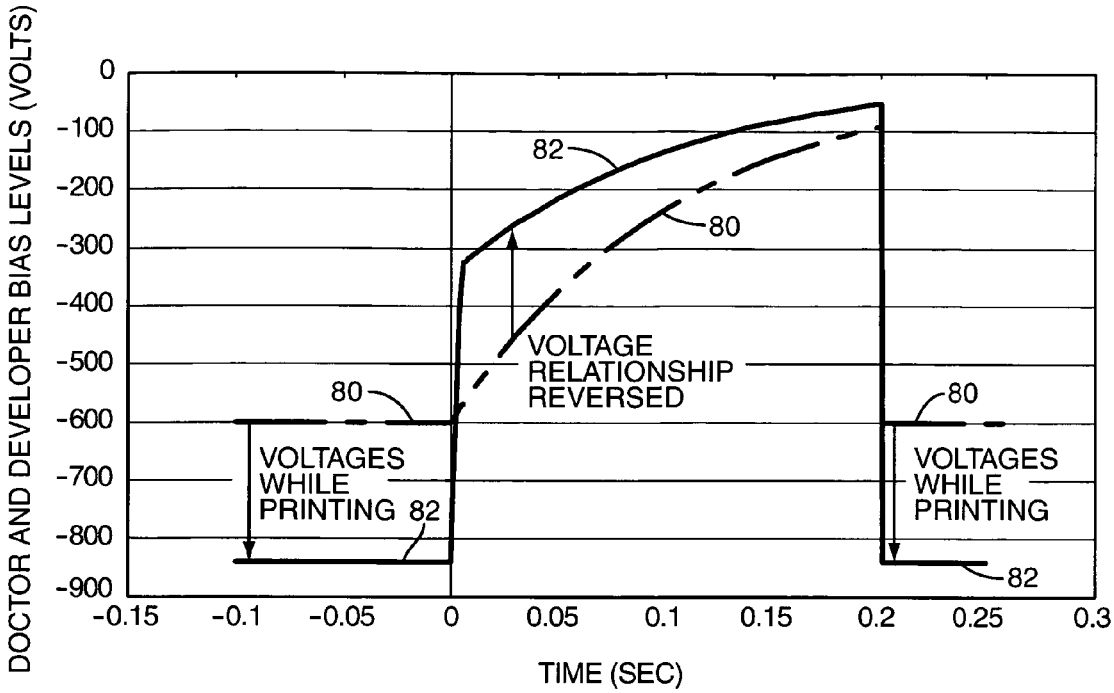
FIG. 5 is a graphical representation of bias levels applied to a doctor element and a developer member before, during, and after field reversal according to one embodiment of the present invention.
Figure 6:
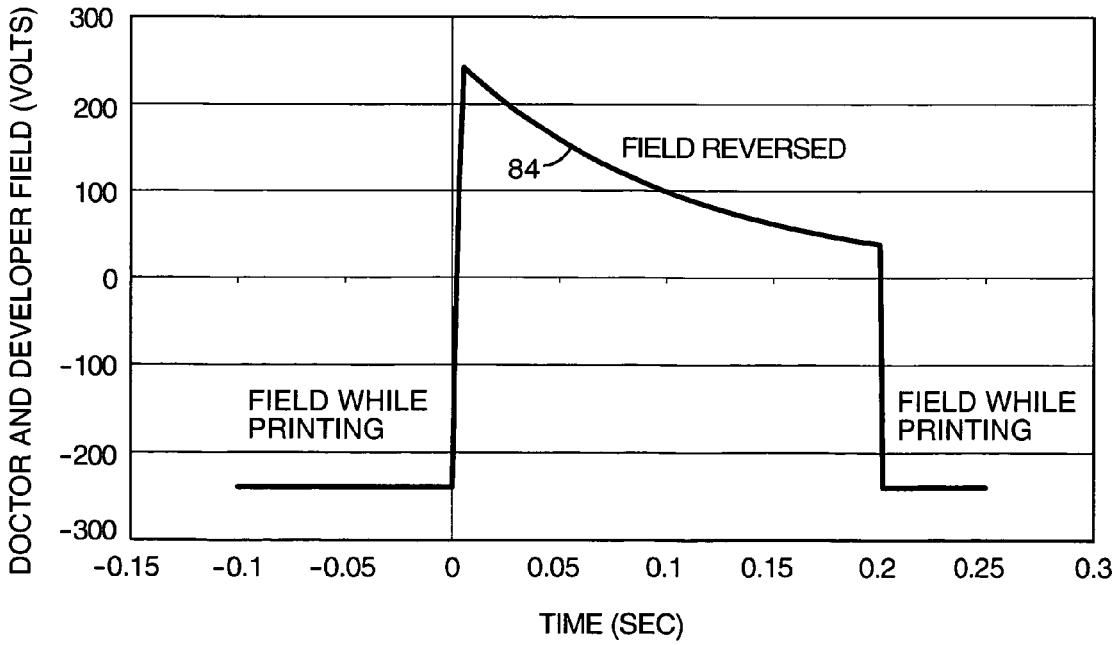
FIG. 6 is a graphical representation of the difference in bias levels applied to a doctor element and a developer member before, during, and after field reversal according to one embodiment of the present invention.

One embodiment of representative voltage levels that are present during the field reversal are graphically illustrated in FIGS. 5 and 6. An alternative embodiment is presented in FIGS. 7 and 8. As indicated above, the doctor element 38 is biased to a larger potential than the developer member 45 during printing. Thus, in the graph shown in FIG. 5, bias curve 82 of doctor element 38 reflects a more negative value than bias curve 80 of developer member 45 during printing. At time zero (0), the HVPS 60 is turned off and the doctor element 38 is quickly pulled towards electrical ground. At this same time, the capacitor C1 resists instantaneous voltage changes and begins feeding its charge to the developer member 45. Therefore, immediately after time zero, bias curve 80 remains at substantially the same value as before time zero. Consequently, the voltage relationship between these two bias curves 80, 82 is reversed after time zero. It is during this time that EPA particles 74 may be cleared from the doctor element 38 and carried away by toner particles 70. Clearing may be further improved if the developer member 45 continues to rotate during this period.

The reversed voltage relationship is also depicted in FIG. 6, which shows a single bias curve 84 representing the bias vector or bias field between the doctor element 38 and the developer member 45. Note that during printing, the bias field is negative in the present embodiment. That is, the bias field reflects the more negative potential applied to the doctor element 38 as compared to the developer member 45 during normal printing. Again, at time zero, this bias field reverses due in part to the effects of the aforementioned Zener diode Z3, capacitor C1, and bleed resistor R2.

Figure 7:
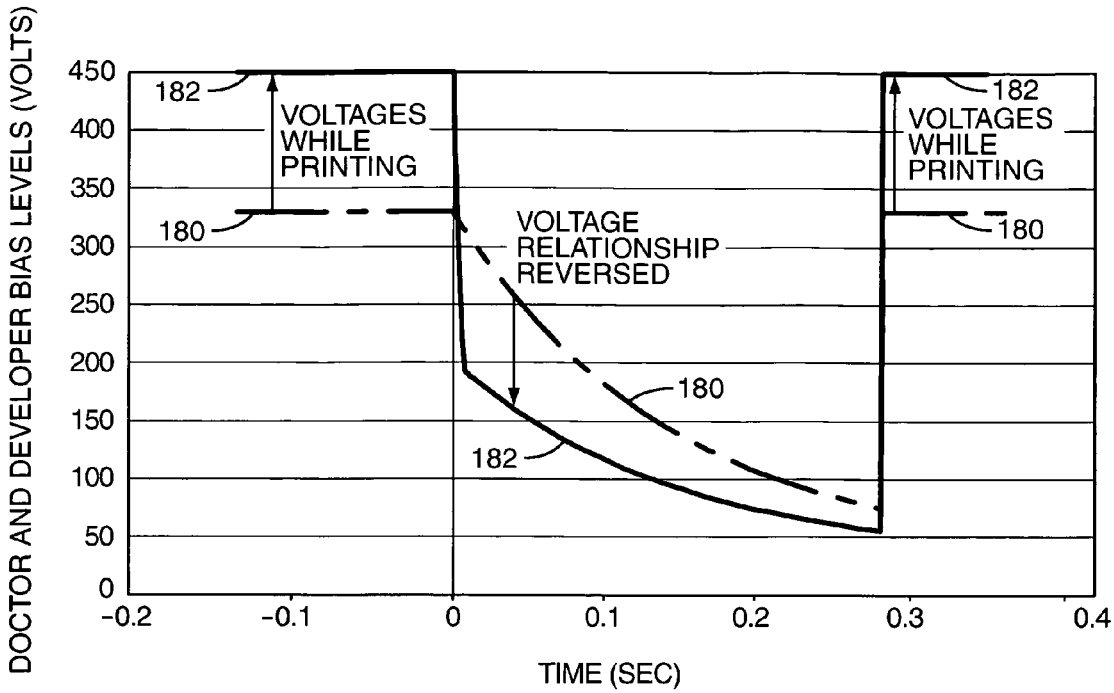
FIG. 7 is a graphical representation of bias levels applied to a doctor element and a developer member before, during, and after field reversal according to one embodiment of the present invention.
Figure 8:
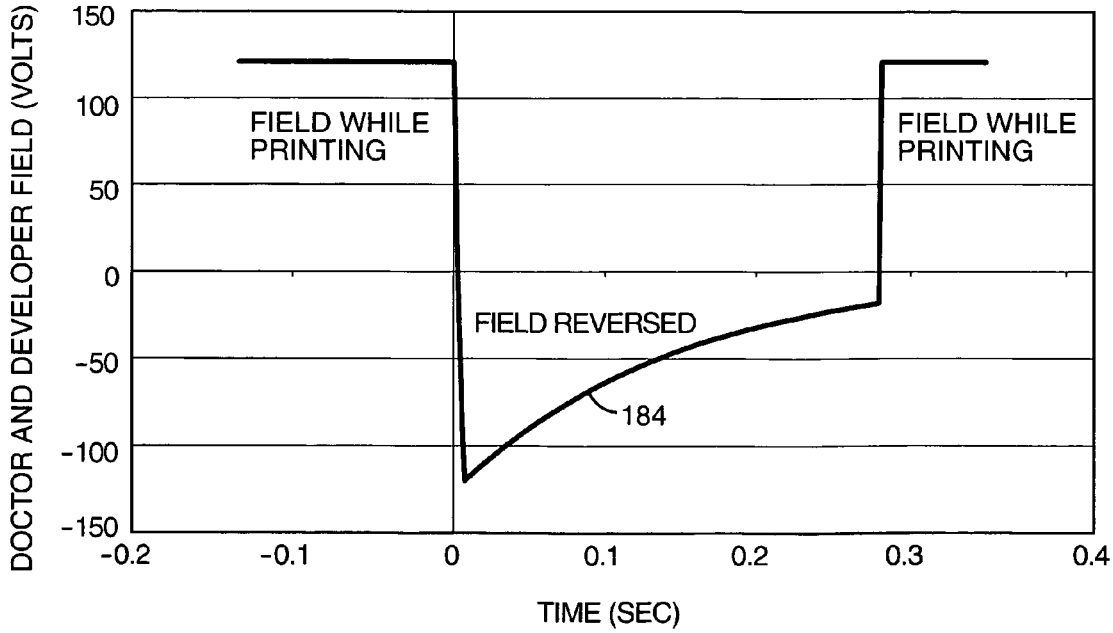
FIG. 8 is a graphical representation of the difference in bias levels applied to a doctor element and a developer member before, during, and after field reversal according to one embodiment of the present invention.

The alternative embodiment illustrated in FIGS. 7 and 8 reflect an image forming device 10 that applies a positive bias to image forming components, including the doctor element 38 and developer member 45, during the printing process. Similar to the graph in FIG. 5, the doctor element 38 is biased to larger potential than the developer member 45 during printing. However, in the graph shown in FIG. 7, bias curve 182 of doctor element 38 reflects a more positive value than bias curve 180 of developer member 45 during printing. At time zero (0), the HVPS 60 is turned off and the doctor element 38 is quickly pulled towards electrical ground. At this same time, the capacitor C1 holds the bias curve 180 at substantially the same value as before time zero. Consequently, the voltage relationship between these two bias curves 180, 182 is reversed after time zero. It is during this time that EPA particles 74 may be cleared from the doctor element 38 and carried away by toner particles 70.

The reversed voltage relationship for this alternative embodiment is also depicted in FIG. 8. As with FIG. 6, a single bias curve 184 represents the bias vector or bias field between the doctor element 38 and the developer member 45. Note that during printing, the bias field is positive in the present embodiment. That is, the bias field reflects the more positive potential applied to the doctor element 38 as compared to the developer member 45 during normal printing. Again, at time zero, this bias field reverses due in part to the effects of the aforementioned Zener diode Z3, capacitor C1, and bleed resistor R2.

It is also worth noting that the magnitude and duration of the bias reversal is different in the alternative embodiment depicted in FIGS. 7 and 8. For example, the bias vector is about 120 volts, which is less than the 240 volts shown in FIGS. 5 and 6. This result may be implemented using a Zener diode having a smaller voltage rating. Further, the time duration for the field reversal is slightly greater, as determined by controller 64. The value of capacitor C1 may be increased to extend the developer decay time correspondingly. Those skilled in the art will comprehend the various modifications that can be applied to the HVPS 60 power circuit to achieve the desired magnitude and duration.

The present invention may be carried out in other specific ways than those herein set forth without departing from the scope and essential characteristics of the invention. For instance, whereas embodiments of the field reversal circuit disclosed herein use a single capacitor C1 to slow the decay of the developer member voltage. It should be understood that more complex and higher order filtering circuits may be used to create longer or shorter time constants for this decay. Also, while a passive method for reversing the doctor blade bias is simple and low in cost, other field reversal methods can be used. This includes active switching (e.g., with a bipolar or field-effect transistor) to discharge the doctor blade. Alternatively, switching may be induced using separate doctor element and developer member power supplies. Additionally, the doctor element clearing scheme disclosed herein may be incorporated in a variety of image forming devices including, for example, printers, fax machines, copiers, and multi-functional machines including vertical and horizontal architectures as are known in the art of electrophotographic reproduction. The present embodiments are, therefore, to be considered in all respects as illustrative and not restrictive, and all changes coming within the meaning and equivalency range of the appended claims are intended to be embraced therein.

What is claimed is:

1. In an image forming device, a method of clearing toner particles from a doctor element comprising:

biasing a doctor element and a developer member to different potentials with a single power supply and a voltage dividing circuit, the doctor element being biased to a larger potential than the developer member;

removing power from the power supply, thereby causing the doctor element bias level to fall towards electrical ground with a first time constant and causing the developer member bias level to fall towards electrical ground with a second time constant that is longer than the first time constant.

2. The method of claim 1 wherein the biasing a doctor element and a developer member to different potentials with a single power supply and a voltage dividing circuit comprise regulating a potential difference between the doctor element and the developer member using a zener diode.

3. The method of claim 1 further comprising pulling the doctor element bias level towards electrical ground using a bleed resistor.

4. The method of claim 3 further comprising pulling the developer member bias level towards electrical ground using the bleed resistor.

5. The method of claim 1 further comprising maintaining the developer member bias level at a substantially constant value before and after removing power from the power supply.

6. The method of claim 4 wherein maintaining the developer member bias level at a substantially similar value is accomplished by coupling one or more energy storage elements to the developer member.

7. The method of claim 1 further comprising regulating the magnitude of a difference between the doctor element bias level and the developer member bias level after removing power from the power supply.

8. The method of claim 1 wherein the toner particles are extra-particulate additives.

9. The method of claim 1 wherein the toner particles possess a substantially different charge than a composite toner charge level.

10. The method of claim 1 wherein the toner particles are substantially smaller than a mean toner particle size.

11. An image forming device comprising:

one or more image forming units, each of the one or more image forming units having a doctor element and a developer member;

a power supply adapted to charge the developer member to a first electrical potential and further adapted to charge the doctor element to a second electrical potential that is higher than the first electrical potential, the difference between the first and second electrical potentials forming a doctor field having a first polarity; and doctor field reversing circuitry adapted to reverse the doctor field to a second polarity opposite from the first polarity when the power supply is turned off.

12. The image forming device of claim 11 wherein the doctor field reversing circuitry comprises an energy storage element coupled to the developer member.

13. The image forming device of claim 12 wherein the energy storage element causes the electrical potential of the developer member to decay at a slower rate than that of the doctor element when the power supply is turned off.

14. The image forming device of claim 12 wherein the energy storage element is a capacitor.

15. The image forming device of claim 11 wherein the doctor field reversing circuitry comprises a zener diode to regulate the magnitude of the doctor field when the doctor field is reversed to the second polarity.

16. The image forming device of claim 11 further comprising a bleed resistor adapted to pull the electrical potentials of developer member and the doctor element toward electrical ground.

17. The image forming device of claim 11 wherein the reversed doctor field is configured to disperse an accumulation of extra-particulate additives from the doctor element.

18. An image forming device comprising:

a photoconductive element on which latent images are formed;

a developer member adapted to supply toner particles to develop the latent images on the photoconductive element, the developer member biased to a first electrical potential;

a doctor element adapted to control the formation of a layer of toner on the developer member, the doctor element biased to a second electrical potential that is higher than the first electrical potential, the doctor element and the developer member biased from a single voltage supply and a voltage dividing circuit; and a bias reversing circuit comprising one or more energy storage elements and a voltage regulator, the bias reversing circuit causing the second electrical potential to fall below that of the first electrical potential when a voltage from the voltage supply is reduced by an amount greater than the magnitude of the voltage regulator.

19. The image forming device of claim 18 wherein the voltage from the voltage supply is reduced by an amount greater than the magnitude of the voltage regulator between print jobs.

20. The image forming device of claim 18 wherein the developer member and the doctor element are biased to negative electrical potentials.

21. The image forming device of claim 18 wherein the developer member and the doctor element are biased to positive electrical potentials.

22. The image forming device of claim 18 wherein the one or more energy storage elements is a capacitor.

23. The image forming device of claim 18 wherein the voltage regulator comprises a zener diode.

24. The image forming device of claim 18 wherein the magnitude and duration for which the second electrical potential falls below that of the first electrical potential causes extra-particulate toner additives to detach from the doctor element.

* * * * *